US007806520B2

(12) United States Patent
Watanabe

(10) Patent No.: US 7,806,520 B2
(45) Date of Patent: Oct. 5, 2010

(54) INK SUPPLY APPARATUS AND INK JET RECORDING APPARATUS

(75) Inventor: Shigeru Watanabe, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 812 days.

(21) Appl. No.: 11/735,139

(22) Filed: Apr. 13, 2007

(65) Prior Publication Data

US 2007/0242113 A1 Oct. 18, 2007

(30) Foreign Application Priority Data

Apr. 14, 2006 (JP) ..... 2006-112603

(51) Int. Cl.
*B41J 2/175* (2006.01)
*B41J 2/19* (2006.01)

(52) U.S. Cl. ..... 347/85; 347/92

(58) Field of Classification Search ..... 347/85, 347/92

See application file for complete search history.

(56) References Cited

U.S. PATENT DOCUMENTS 4,419,678 A * 12/1983 Kasugayama et al. ..... 347/86
6,805,437 B2 12/2003 Yamanaka
6,702,433 B2 * 3/2004 Kono ..... 347/85

FOREIGN PATENT DOCUMENTS

JP 2002-307709 A 10/2002

* cited by examiner

*Primary Examiner*—Stephen D Meier
*Assistant Examiner*—Geoffrey Mruk
(74) *Attorney, Agent, or Firm*—Canon USA Inc IP Div

(57) ABSTRACT

An ink supply apparatus for supplying ink from an ink tank to a recording head includes an atmosphere communication chamber that is connected to the ink tank, a first hollow tube that connects the atmosphere communication chamber to the outside air wherein one end is extended into the atmosphere communication chamber, and a second hollow tube that connects the atmosphere communication chamber to the outside air wherein one end is extended into the atmosphere communication chamber. The length of extension of the second hollow tube is different from the length of extension of the first hollow tube.

4 Claims, 4 Drawing Sheets

INK SUPPLY APPARATUS AND INK JET RECORDING APPARATUS

BACKGROUND OF THE INVENTION

1. Field of the Invention

The present invention relates to an ink supply apparatus and an ink jet recording apparatus.

2. Description of the Related Art

Japanese Patent Application Laid-Open No. 2002-307709 (corresponding to U.S. Pat. No. 6,805,437) discusses an ink supply system of an ink jet recording apparatus, which is an example of the conventional ink jet recording apparatus shown in FIG. 4.

A recording head 101 has a sub tank 101*b*. The sub tank 101*b* holds a predetermined amount of ink supplied through a tube 106 from a main tank 104 mounted on the main body of the ink jet recording apparatus.

The main tank 104 is detachably mounted on a supply unit 105, which is provided with an ink supply port sealed by a rubber stopper 104*b* and an atmosphere introduction port sealed by a rubber stopper 104*c*, at its base portion. The main tank 104 is an air-tight container as a unit. The ink 109 is directly contained inside the main tank 104 without being immersed into an ink absorber.

The ink supply unit 105 includes an ink supply needle 105*a* and an air introducing needle 105*b*. The ink supply needle 105*a* draws out the ink 109 from the main tank 104 and supplies the ink to the recording head 101. The air introducing needle 105*b* introduces air from an air communication port 105*g* into the main tank 104. The main tank 104 is attached to the ink supply unit 105, and the ink introducing needle 105*a* and the air introducing needle 105*b* penetrate the rubber stoppers 104*b* and 104*c* to enter an interior of the main tank 104. That is, the main tank 104 is attached to the ink supply unit 105 so that a liquid path from the recording head 101 to the ink supply needle 105*a*, and a liquid path from the air introducing needle 105*b* to the atmosphere communication port 105*g* are connected as a single liquid path. The ink is supplied from a connector inserting slot 101*a* to the recording head 101. A liquid connector provided at an end of the ink supply tube 106 is connected airtight to the connector inserting slot 101*a*.

In the above-described head and the ink supply system, when the air in the recording head 101 and the main tank 104 expands due to change in the ambient temperature, it is necessary to prevent the ink from flowing out from the atmosphere communication port 105*g*. Accordingly, the atmosphere communication chamber 105*f* is arranged between the air introducing needle 105*b* and the atmosphere communication port 105*g* so that the overflowing ink can be temporarily stored therein.

A liquid path 105*k* from the atmosphere communication chamber 105*f* to the atmosphere communication port 105*g* has a predetermined cross-sectional area. A portion of the liquid path is positioned higher than the port of the air introducing needle 105*b* in order to prevent the ink inside the atmosphere communication chamber 105*f* from leaking outside when the apparatus is inclined to some extent.

In the above-described configuration, when the ink inside the recording head 101 is consumed, the ink is supplied from the main tank 104 to the recording head 101 through the ink supply unit 105 and the ink supply tube 106, due to the negative pressure. At this time, the same amount of air as the ink supplied from the main tank 104 is introduced into the main tank 104 from the atmosphere communication port 105*g*, through the atmosphere communication chamber 105*f* and the air introducing needle 105*b*.

The air permeating and intruding through a resinous material of the tube 106, or the air dissolved and contained inside the ink can cause air accumulation inside the sub tank 101*b*, which causes a problem. Moreover, the ink supply can fail when the ink inside the sub tank 101*b* becomes empty.

The accumulated air is removed by a sequential operation of a shut-off valve 110 situated at a flow path from the recording head 101 to the ink supply needle 105*a*, in association with a recovery unit 107 that includes a suction cap 107*a* that sucks the discharge nozzles 101*g*, and the suction pump 107*b*.

However, the conventional example described above has a problem that the ink may leak not from the main tank 104 side but from the recording head 101 side. In this state where the ink of the main tank 104 flows into the atmosphere communication chamber 105*f* due to an increase in the ambient temperature, if the recording head 101 is forcibly removed or the ink supply tube 106 is cut, the following problems occur: after the atmosphere communication chamber 105*f* is filled with the ink, once the ink starts to flow outside from the liquid path 105*k* that connects the atmosphere communication chamber 105*f* to the atmosphere, a siphon principle comes to act. When the siphon principle acts, a tube saturated with the ink of the main tank 104 creates a continuous ink flow until all ink inside the main tank 104 is empty. According to the siphon principle, when a fluid flows down the tube in a saturated condition, a suction effect occurs at an upstream side of the fluid flow. Moreover, once the apparatus is inclined, meniscus of the recording head is broken. As a result, the ink fills up the entire liquid path 105*k* that connects the atmosphere communication chamber 105*f* to the outside air, and the ink is discharged from the atmosphere communication port 105*g* to the outside.

The negative pressure inside the main tank 104 increases, and the same amount of ink as that flowed out to the outside, flows into the main tank 104 via the tube 106 from the recording head in which meniscus is broken. If the ink continues to be supplied from the main tank 104 to the air introducing needle 105*b*, the ink continues to flow out from the atmosphere communication port 105*g* to the outside. As a result, the ink inside the main tank 104 becomes empty.

SUMMARY OF THE INVENTION

The present invention is directed to an ink supply apparatus and an ink jet recording apparatus capable of preventing the unnecessary ink leakage from the atmosphere communication chamber.

According to an aspect of the present invention, an ink supply apparatus configured to supply ink from an ink tank to a recording head, includes an atmosphere communication chamber that is connected to the ink tank; a first hollow tube that connects the atmosphere communication chamber to the outside air, wherein one end of the first hollow tube extends into the atmosphere communication chamber; and a second hollow tube that connects the atmosphere communication chamber to the outside air, wherein one end of the second hollow tube extends into the atmosphere communication chamber. The first hollow tube and the second hollow tube extend into the atmosphere communication chamber with differing lengths.

According to an another aspect of the present invention, an ink supply apparatus configured to supply ink from an ink tank to a recording head, includes an atmosphere communication chamber that is connected to the ink tank; a first air path which connects the atmosphere communication chamber to the atmosphere, and has a first port provided inside the atmosphere communication chamber; and a second air path which connects the atmosphere communication chamber to the atmosphere, and has a second port provided inside the atmosphere communication chamber, wherein the first port and the second port have different heights in a direction of gravity.

According to the ink supply apparatus of exemplary embodiments of the present invention, change in the negative pressure inside the tank is reduced, which can prevent the unnecessary ink leakage from the atmosphere communication chamber.

Moreover, according to the ink supply apparatus of exemplary embodiments of the present invention, the atmosphere communication chamber can constantly maintain an air and liquid exchangeable state between the hollow tubes and the outside air, which can prevent the unnecessary ink leakage from the atmosphere communication chamber.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DETAILED DESCRIPTION OF THE EMBODIMENTS

Various exemplary embodiments, features, and aspects of the invention will be described in detail below with reference to the drawings.

First Exemplary Embodiment

Figure 1:
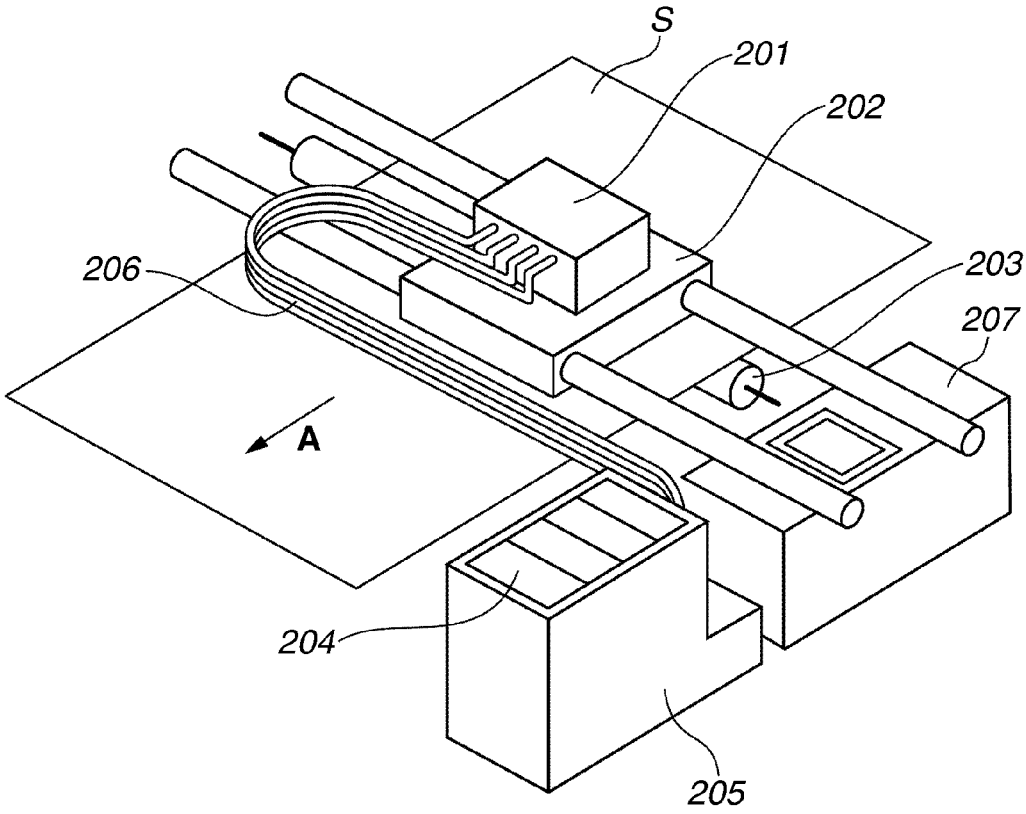
FIG. 1 illustrates a perspective view showing a configuration of an ink jet recording apparatus in accordance with exemplary embodiments of the present invention.

FIG. 1 illustrates a perspective view showing the configuration of the ink jet recording apparatus in accordance with exemplary embodiments of the present invention.

The ink jet recording apparatus of FIG. 1 is capable of repeating the reciprocal motion of a recording head 201 (main scanning), and the conveyance of a recording sheet S (recording medium) by a predetermined pitch (subscanning) so that the recording head 201 can selectively discharge ink in synchronization with these motions. The ink sticks to the recording sheet S to form a character, a symbol, or an image. Examples of the recording sheets include an ordinary recording paper, a special paper, and an OHP film.

Referring to FIG. 1, the recording head 201 is detachably mounted on a carriage 202. The carriage 202 is slidably supported by two guide rails and is reciprocated along the guide rails by a drive unit such as a motor (not illustrated). The recording sheet S is conveyed by a conveying roller 203 in a direction intersecting with the moving direction of the carriage 202 (for example, a perpendicular direction represented by arrow A). The recording sheet S faces an ink discharge face of the recording head 201 and maintains a constant distance from the ink discharge face.

The recording head 201 includes a plurality of nozzle arrays for discharging inks of different colors. Corresponding to the colors of the inks discharged from the recording head 201, plural independent ink tanks 204 are detachably mounted onto an ink supply unit 205. The ink supply unit 205 and the recording head 201 are connected respectively by plural ink supply tubes 206 corresponding to the ink colors. The main tank 204 is mounted onto the ink supply unit 205 so that the inks of respective colors contained in the main tank 204 can be independently supplied to the nozzle arrays in the recording head 201.

In a non-recording area, which is within the reciprocating range of the recording head 201 but outside the passing range of the recording sheet S, a recovery unit 207 is provided such that it faces the ink discharge face of the recording head 201.

Figure 2:
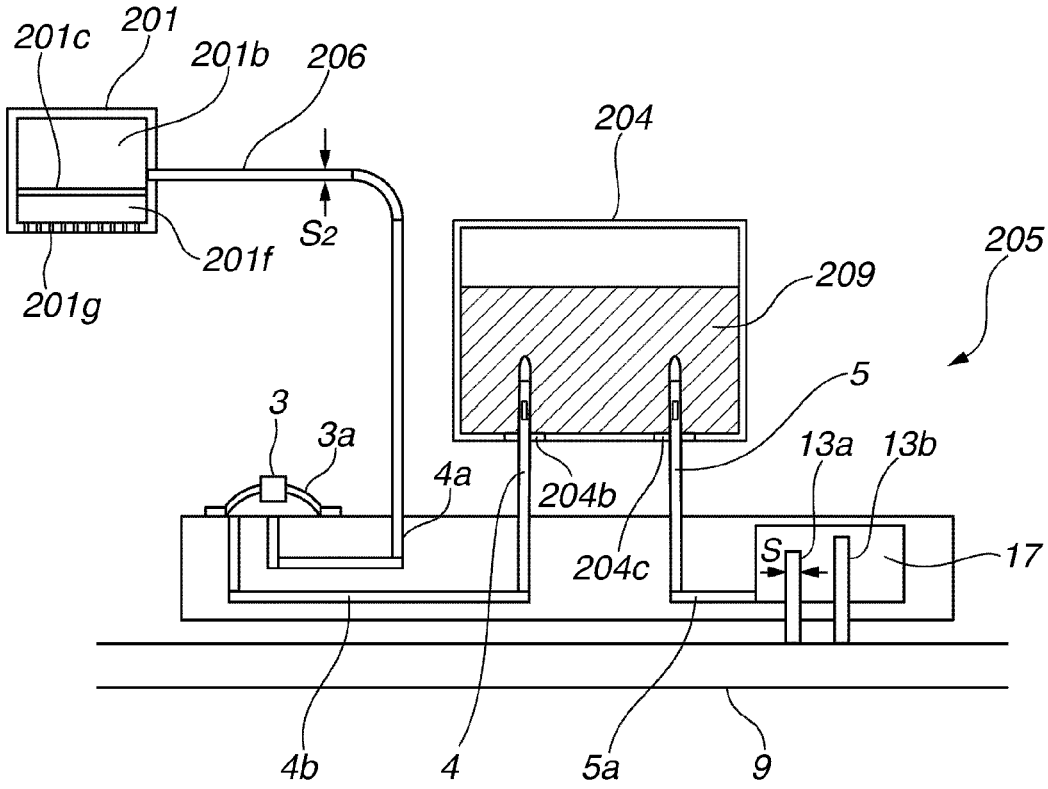
FIG. 2 illustrates a view showing an ink supply path in the ink jet recording apparatus of FIG. 1.
Figure 3:
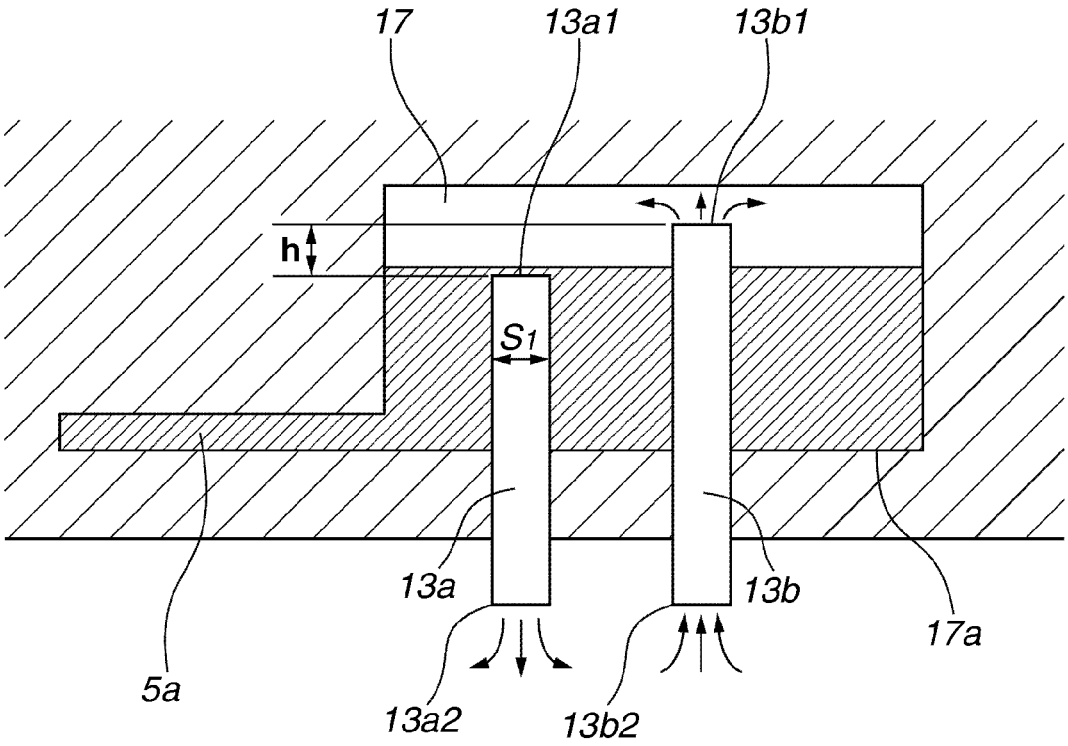
FIG. 3 illustrates an enlarged cross-sectional view of the atmosphere communication chamber of the ink jet recording apparatus of FIG. 1.
Figure 4:
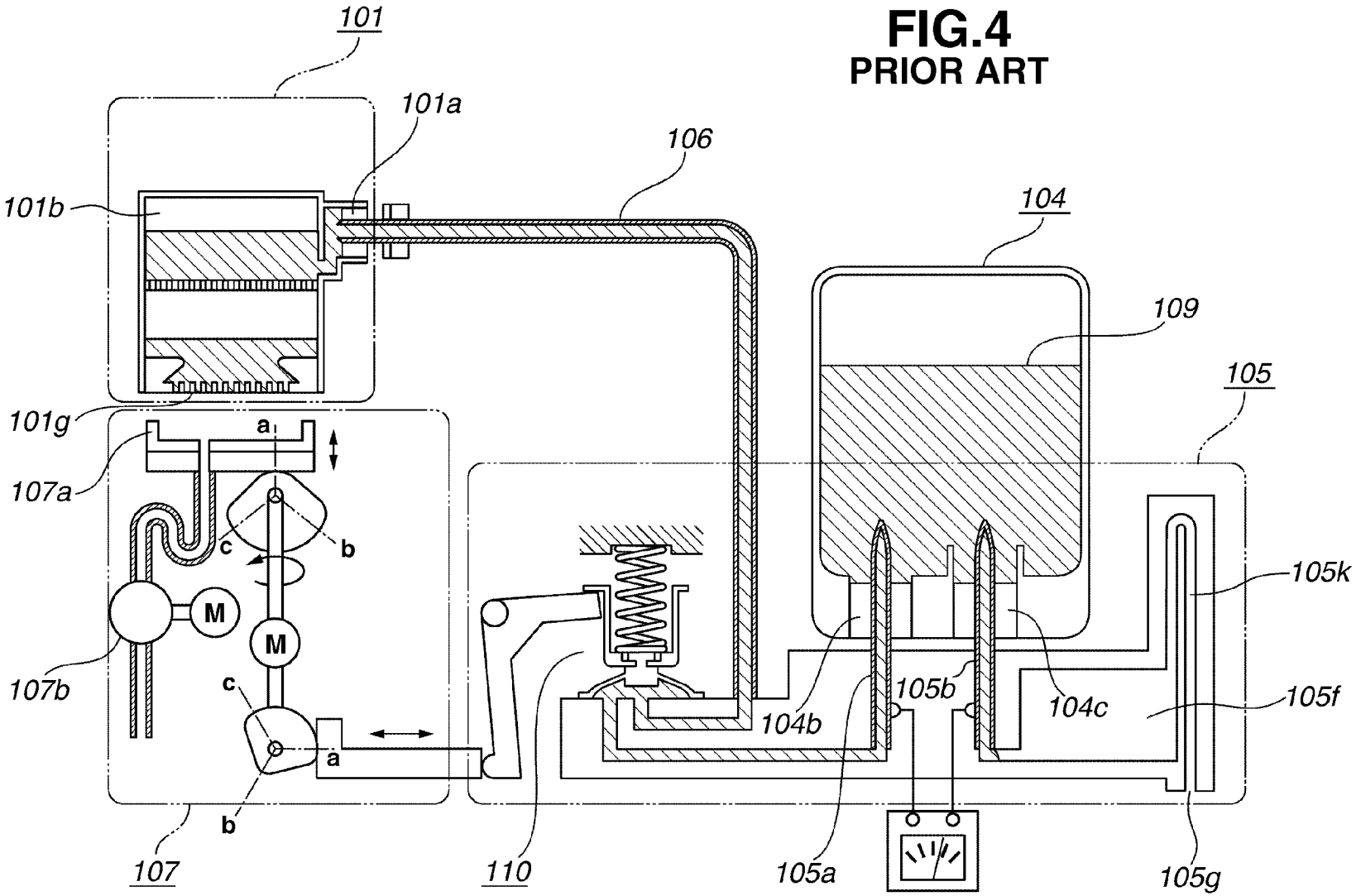
FIG.4 PRIOR ART
FIG. 4 illustrates one example of the ink supply system in the conventional ink jet recording apparatus.

The detailed configuration of the ink supply system of the ink jet recording apparatus will be described below with reference to FIGS. 2 and 3. FIG. 2 is a view illustrating the ink supply path of the ink jet recording apparatus of FIG. 1 that shows the path of one color for the purpose of simplicity. FIG. 3 is an enlarged cross-sectional view of the atmosphere communication chamber.

An ink supply path starting from the main tank 204 side to the recording head 201 includes an ink supply needle 4, a liquid path 4*b*, a valve 3, a liquid path 4*a*, and an ink supply tube 206, in this order. Moreover, a path starting from the main tank 204 side to the outside air (atmosphere) includes an air introducing needle 5, a liquid path 5*a*, an atmosphere communication chamber 17, a first hollow tube 13*a*, and a second hollow tube 13*b*, in this order.

An interior of the recording head 201 is provided with a filter 201*c*, a liquid path 201*f*, and a sub tank 201*b*. The filter 201*c* can be made of a minute mesh that prevents dust from clogging a discharge nozzle 201*g* including fine holes. The liquid path 201*f* connects the filter 201*c* and the discharge nozzle 201*g*. The sub tank 201*b* formed in the upstream of the filter 201*c* can store ink of a predetermined amount supplied from the main tank 204 through the tube 206. The main tank 204 is mounted onto the main body of the ink jet recording apparatus.

The main tank 204 can be detachably mounted onto the supply unit 205. In the base, the main tank 204 is provided with an ink supply port and an atmosphere introduction port. The ink supply port is tightly sealed with a rubber stopper 204*b*, and an atmosphere introduction port is sealed with a rubber stopper 204*c*. The main tank 204 is an air-tight container as a unit. The ink 209 is directly contained in the main tank 204 without being immersed into the ink absorber.

The ink supply unit 205 includes the shut-off valve 3, the ink supply needle 4, the air introducing needle 5, the atmosphere communication chamber 17, the first hollow tube 13*a*, the second hollow tube 13*b*, and the liquid paths 4*a*, 4*b* and 5*a*.

The shut-off valve 3 includes a rubber diaphragm 3*a* that is displaced to open or close the connection between the two liquid paths 4*a* and 4*b*. The shut-off valve 3 is opened during the ink discharge from the recording head 201, but is closed during a standby state or a non-operating state. The shut-off valve 3 is opened and closed in synchronization with the recovery unit 207 during an ink filling operation to remove air accumulated inside the recording head 201.

Negative pressure is applied to the discharge nozzle 201*g* of the recording head 201 due to a difference of the head between the discharge nozzle 201*g* and the main tank 204. A meniscus of the ink is formed on the discharge nozzle 201*g* by a balance of the negative pressure coming from the difference of the head, and ink holding force at the discharge nozzle 201*g*. The negative pressure inside the recording head 201 becomes larger when the ink is discharged from the discharge nozzle 201*g*, and the ink is supplied from the main tank 204 to the recording head 201 through the ink supply path.

The shut-off valve 3 is opened during normal recording. The ink 209 inside the main tank 204 is supplied to the recording head 201 through the ink supply needle 4 and the ink supply tube 206, when the negative pressure inside the recording head 201 becomes higher due to the ink discharge. However, as the ink is being supplied, the bubbles remaining in the ink supply tube 206 are accumulated inside the recording head 201. Accordingly, a cleaning operation that removes bubbles is executed. That is, the shut-off valve 3 is closed under a predetermined condition to increase the negative pressure inside the recording head 201. Thus, a predetermined amount of bubbles is collected inside the recording head 201.

The ink supply needle 4 can be a hollow needle that supplies the ink 209 from the main tank 204, and is disposed corresponding to the ink supply port of the main tank 204.

The air introducing needle 5 can be a hollow needle that introduces air into the main tank 204, and is disposed corresponding to the atmosphere introduction port. One end of the air introducing needle 5 is inserted into the main tank 204, and the other end is connected to the liquid path 5*a*. The liquid path 5*a* leads to the atmosphere communication chamber 17 which is independently provided for each main tank. The air introducing needle 5 is connected to the atmosphere through the liquid path 5*a*, the atmosphere communication chamber 17, the first hollow tube 13*a*, and the second hollow tube 13*b*. The main tank 204 is connected only to the ink supply needle 4 and the air introducing needle 5.

The atmosphere communication chamber 17 has a function of maintaining the pressure inside the recording head 201 constant. Moreover, the atmosphere communication chamber 17 has also a buffer function of temporarily holding the ink to prevent ink leaking from the hollow tubes 13*a* and 13*b* in the case where the air in the recording head 201 and the main tank 204 expands due to changes in the ambient temperature. In other words, in the case where the air inside the recording head 201 and the main tank 204 expands due to temperature changes, the pressure inside the recording head 201 can be maintained constant by releasing the ink into the atmosphere communication chamber 17. Further, the ink flowing out due to the expansion can be held in the atmosphere communication chamber 17. However, if the amount of flowing ink is large and the ink leaks from the atmosphere communication chamber 17, the ink is expelled via the first hollow tube 13*a* and absorbed by the waste ink absorber 9.

The first hollow tube 13*a* (i.e., a first air path) and the second hollow tube 13*b* (i.e., a second air path) penetrate a base 17*a* of the atmosphere communication chamber 17 and are mounted thereon. The first hollow tube 13*a* connects the atmosphere communication chamber 17 to the outside air. In addition, the first hollow tube 13*a* has a function of expelling the ink inside the atmosphere communication chamber to the outside. The second hollow tube 13*b* has a function of connecting the atmosphere communication chamber 17 to the atmosphere.

A first port 13*a*1, which is one end of the first hollow tube 13*a*, and a second port 13*b*1, which is one end of the second hollow tube 13*b*, are positioned inside the atmosphere communication chamber 17. Other ends 13*a*2 and 13*b*2 are open to the atmosphere. The second port 13*b*1 is set higher than the first port 13*a*1 of the first hollow tube 13*a* in a direction of gravity by a height h. In other words, an extension of the second hollow tube 13*b* into the atmosphere communication chamber 17 is higher than an extension of the first hollow tube 13*a*, by the height h. Further, the height h is set to be higher than a height of ink swelling caused by surface tension at the end 13*a*1 of the first hollow tube 13*a*, in order to prevent the ink from flowing out from the second hollow tube 13*b* side due to the swelling. The larger the difference in the extension length of the hollow tubes 13*a* and 13*b* inside the atmosphere communication chamber 17, the more the effect of preventing the ink leakage. However, if the height h gets larger, the volume of the atmosphere communication chamber 17 becomes also larger. The height h can be set to be higher than the height of the ink which swells due to surface tension and flows out from the one end 13*a*1 of the first hollow tube 13*a*. In order to prevent the ink from flowing out from the second hollow tube 13*b* due to the swelling, the height h has to be 1 mm or more, which is higher than the height of ink swelling from one end 13*a*1 of the first hollow tube 13*a* caused by surface tension. According to the experiment, h=1.5 mm is found to be sufficiently effective.

The other ends 13*a*2 and 13*b*2 are disposed higher than the waste ink absorber 9. The other ends 13*a*2 and 13*b*2 are disposed lower than the ends 13*a*1 and 13*a*2, in a direction of gravity. The waste ink absorber 9 is disposed lower than the ends 13*a*2 and 13*b*2 in the direction of gravity.

A cross-sectional area S1 of the first hollow tube 13*a* is greater than the smallest cross-sectional area among various cross-sectional areas of the ink supply path from the main tank 204 to the recording head 201. According to the present exemplary embodiment, the cross-sectional area S1 of the first hollow tube 13*a* is larger than a cross-sectional area S2 of the ink supply tube 206 because of a following reason:

Suppose that the air gets in the ink supply tube 206 due to the breaking of meniscus of the recording head 201 or breaking of the ink supply tube 206. The ink inside the ink supply tube 206 flows into the main tank 204 due to the air mixing, and flows out from the first hollow tube 13*a* to the outside. The amount of ink flowing out of the first hollow tube 13*a* under this situation is determined by the difference of potential head between ends 13*a*1, 13*a*2 of the first hollow tube 13*a* due to the leakage, the cross-sectional area S1 of the first hollow tube 13*a* and the cross-sectional area S2 of the ink supply tube 206. Moreover, the smaller the cross-sectional area of the tube, the greater is its inner resistance.

Now, assume that the cross-sectional area S1 of the first hollow tube 13*a* is smaller than the cross-sectional area S2 of the ink supply tube 206. In this case, the amount of ink flowing into the atmosphere communication chamber 17 from the ink supply tube 206 side, exceeds the amount of ink that can be discharged through the first hollow tube 13*a* to the outside of the atmosphere communication chamber 17. As a result, the ink accumulates inside the atmosphere communication chamber 17, and an ink surface starts to rise. If the ink surface becomes higher than the height h, the ink starts to flow into the second hollow tube 13*b* to impair the air introducing function of the second hollow tube 13*b*. This accelerates the ink accumulation inside the atmosphere communication chamber 17, and in the end, the second hollow tube 13*b* and the atmosphere communication chamber 17 are completely filled up with the ink. Under such circumstance, based on the siphon principle, the ink continues to flow out until the ink inside the atmosphere communication chamber 17 is completely empty.

In contrast, in the present exemplary embodiment, the cross-sectional area S1 of the first hollow tube 13*a* is larger than the cross-sectional area S2 of the ink supply tube 206, as described above. That is, the amount of ink discharged to the outside of the atmosphere communication chamber via the first hollow tube 13*a* exceeds the amount of ink flowing into the atmosphere communication chamber 17 from the ink supply tube 206 side through the main tank 204. Accordingly, a height from the base 17*a* to the ink surface inside the atmosphere communication chamber 17 is maintained at a position of the one end 13*a*1 of the first hollow tube 13*a*, and does not reach a position of the one end 13*b*1 of the second hollow tube 13*b*. Therefore, the second hollow tube 13*b* will not be filled with the ink. As a result, air can be continuously supplied to the atmosphere communication chamber 17. Because the atmosphere communication chamber 17 is not filled with the ink, and the action of the siphon principle can be avoided, the ink inside the main tank 204 is prevented from completely flowing out.

Further, according to the above example, the number of the first hollow tube 13*a* and second hollow tube 13*b* are one respectively. However, the number of hollow tubes is not limited but can be three or more. In the case where three or more kinds of hollow tubes are provided, the extensions of hollow tubes into the atmosphere communication chamber 17 can be of three or more kinds. In this case, the longest extension is treated as the second hollow tube 13*b*, and all other hollow tubes as first hollow tubes 13*a*. That is, a plurality of first hollow tubes 13*a* are provided in this case. A cross-sectional area S1 of the first hollow tube 13*a* is a total of the cross-sectional areas of the first hollow tubes 13*a*. The total cross-sectional area S1 is greater than the cross-sectional area S2 of the ink supply tube 206. That is, the longest hollow tube can be the air introducing tube, and all other hollow tubes can be the tubes for discharging the ink.

Moreover, the first hollow tube 13*a* and the second hollow tube 13*b* can have a circular cross section; however, other shapes such as ellipse and rectangle can be employed.

As described above, according to the present exemplary embodiment, the atmosphere communication chamber 17 can always be kept in an air-and-liquid-exchangeable state by the first hollow tube 13*a* and the second hollow tube 13*b*. Even if the meniscus of the head is broken, the change in the negative pressure inside the main tank can be absorbed by the atmosphere communication chamber 17. Therefore, the siphon principle (the suction effect occurring at the upstream side of a fluid flow in a tube filled with the fluid) does not occur. Some portion of the ink flows out of the atmosphere communication chamber 17, and after that, the ink flow spontaneously stops. The problem that all ink flows out of the main tank 204 does not occur.

Moreover, since a part of the liquid path of the conventional air communicating path is disposed higher than the port of the air introducing needle, the conventional apparatus needs an extra space that the air communicating path occupies. However, according to the present exemplary embodiment, the air communicating path is disposed within the atmosphere communication chamber 17. Therefore, the apparatus size can be reduced in comparison to the conventional one. According to one exemplary embodiment of the present invention, the atmosphere communication chamber 17 and the first and the second hollow tubes 13*a* and 13*b* can be combined together.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2006-112603 filed Apr. 14, 2006, which is hereby incorporated by reference herein in its entirety.

What is claimed is:

1. An ink supply apparatus configured to supply ink from an ink tank to a recording head, comprising:

an atmosphere communication chamber connected to the ink tank;

a first hollow tube connecting the atmosphere communication chamber to the outside air, wherein one end of the first hollow tube extends into the atmosphere communication chamber; and a second hollow tube connecting the atmosphere communication chamber to the outside air, wherein one end of the second hollow tube extends into the atmosphere communication chamber, wherein the first hollow tube and the second hollow tube extend into the atmosphere communication chamber with differing lengths, and wherein a cross-sectional area of the first hollow tube is larger than a smallest cross-sectional area of a portion of an ink supply path from the ink tank to the recording head.

2. An ink supply apparatus configured to supply ink from an ink tank to a recording head, comprising:

an atmosphere communication chamber connected to the ink tank;

a first hollow tube connecting the atmosphere communication chamber to the outside air, wherein one end of the first hollow tube extends into the atmosphere communication chamber;

a second hollow tube connecting the atmosphere communication chamber to the outside air, wherein one end of the second hollow tube extends into the atmosphere communication chamber, wherein the first hollow tube and the second hollow tube extend into the atmosphere communication chamber with differing lengths; and a plurality of the first hollow tubes.

3. The ink supply apparatus according to claim 2, wherein a total sum of the cross-sectional areas of the first hollow tubes is greater than a smallest cross-sectional area of a portion of an ink supply path from the ink tank to the recording head.

4. An ink supply apparatus configured to supply ink from an ink tank to a recording head, comprising:

an atmosphere communication chamber connected to the ink tank;

a first air path connecting the atmosphere communication chamber and the atmosphere, the first air path having a first port provided inside the atmosphere communication chamber; and a second air path connecting the atmosphere communication chamber and the atmosphere, the second air path having a second port provided inside the atmosphere communication chamber, wherein the first port and the second port have different heights in a direction of gravity, and wherein a cross-sectional area of the first air path is greater than a smallest cross-sectional area of a portion of an ink supply path from the ink tank to the recording head.

* * * * *